United States Patent [19]

Dieringer et al.

[11] 3,943,858

[45] Mar. 16, 1976

[54] MACHINE FOR SETTING TIE PLATES AND THE LIKE

[75] Inventors: Andrew M. Dieringer, Waterford; Frank F. Katcha, Milwaukee, both of Wis.

[73] Assignee: Rexnord Inc., Milwaukee, Wis.

[22] Filed: Feb. 12, 1973

[21] Appl. No.: 331,818

[52] U.S. Cl. ..... 104/16; 104/17 R; 293/5

[51] Int. Cl.[2] ..... E01B 29/24

[58] Field of Search ..... 104/17, 16, 17 R, 17 A, 104/2, 12; 293/4, 5; 105/364

[56] References Cited

UNITED STATES PATENTS

| | | | |
|---|---|---|---|
| 2,920,713 | 1/1960 | Paradise | 293/4 |
| 3,501,040 | 3/1970 | Martelee | 105/364 |
| 3,581,665 | 6/1971 | Johnson | 104/17 R |
| 3,645,209 | 2/1972 | Von Beckmann | 104/12 |
| 3,690,264 | 9/1972 | Plasser et al. | 104/17 R |
| 3,745,930 | 7/1973 | Dieringer | 104/17 R |

*Primary Examiner*—Robert R. Song
*Assistant Examiner*—Richard A. Bertsch
*Attorney, Agent, or Firm*—Kinzer, Plyer, Dorn & McEachran

[57] ABSTRACT

This is a machine for doing work on railroad track and includes a mechanism for setting new tie plates on top of ties so that a new rail may be accurately positioned thereon. The machine is specifically constructed and arranged to accurately set the tie plates so that they do not require further adjustment prior to laying the new rail. The machine is self-propelled and automatic so that it does not require an attendant, other than possibly personnel to feed tie plates to it.

21 Claims, 16 Drawing Figures

32
34
36
52
54
56
60
63
64
65
66
67
68
74
76
78
80
82
88
90
96
98
100
102
138
140

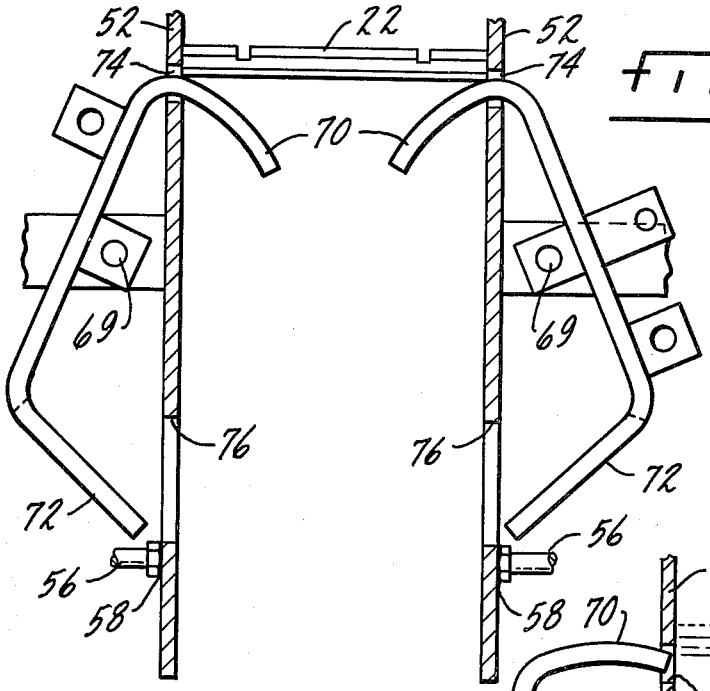
fig.7.
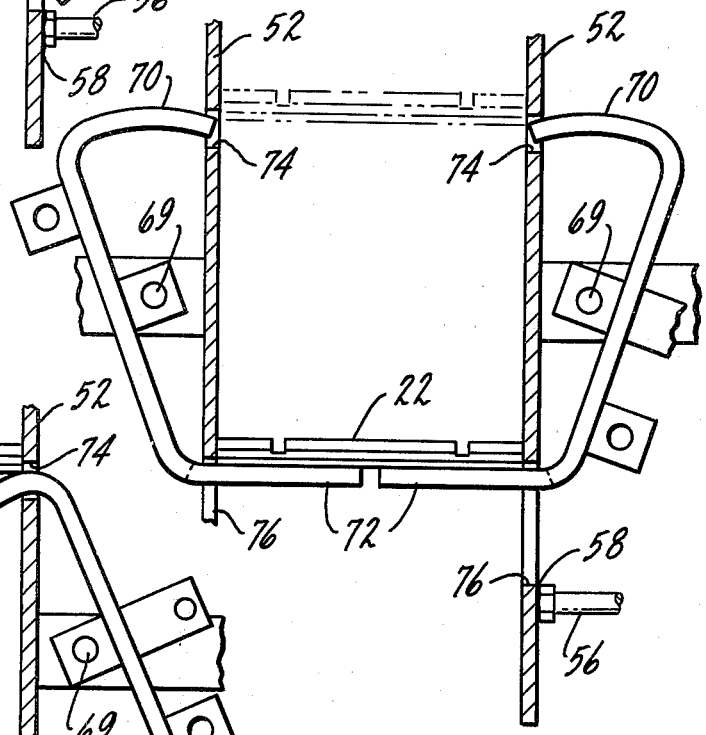
fig.8.
fig.9.
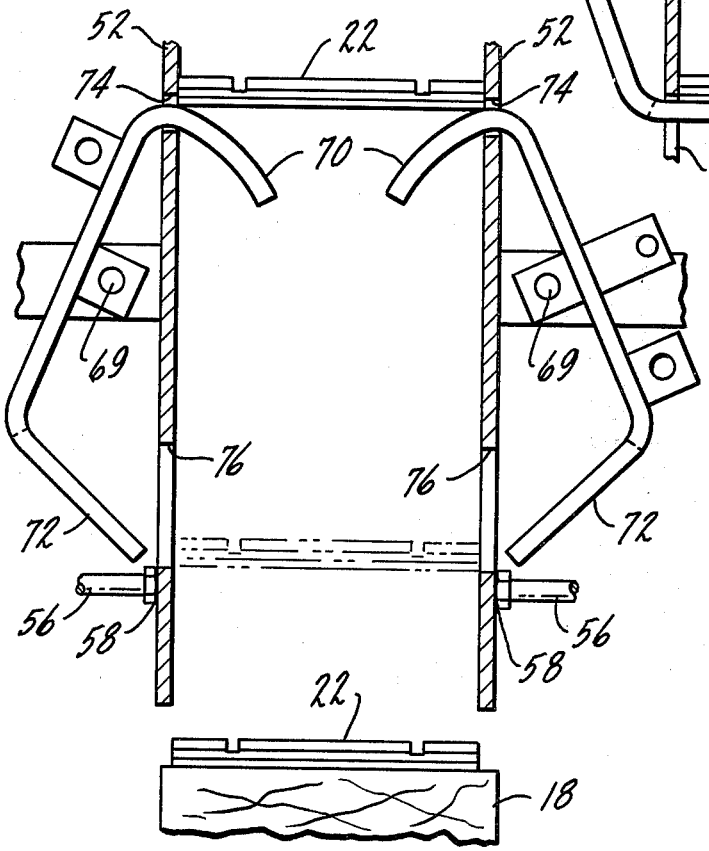

MACHINE FOR SETTING TIE PLATES AND THE LIKE

SUMMARY OF THE INVENTION

This invention is in the field of railroad track working machines and is specifically concerned with a machine for setting new tie plates on top of the ties so that a new rail may be laid thereon.

A primary object of the invention is a machine of the above type which will be quite accurately set tie plates so that they do not require further adjustment or alignment before a new rail is laid.

Another object is a machine of the above type which will replace about four men.

Another object is a machine of the above type which does not need an operator and is practically foolproof.

Another object is a tie plate setter which is constructed to eliminate the step of pregauging the tie plates before laying a new rail.

Another object is a tie plate setter which is constructed to eliminate putting the new tie plates down the center of the track, but rather is designed and arranged to bring them up from the shoulder and accurately position them on the ties.

Another object is a tie plate setter which is practically completely automatic in that one or two men or attendants feed tie plates from the shoulder, either one shoulder or the other, and the machine automatically indexes itself along the track from tie to tie, depositing a tie plate on each tie, automatically stops if it is short of tie plates and automatically refuses to accept more tie plates when it is enough in transit or storage.

Another object is a tie plate setter which is specifically balanced so that a wheel, skid or what-have-you does not run over the just set tie plates, thereby eliminating misalignment of the tie plates after they are set.

Another object is a tie plate setter which is specifically constructed to bring tie plates up from the shoulder which eliminates the safety problems involved with tie plates lying between the rails.

Another object is a machine of the above type which completely replaces or eliminates the necessity for a pregauger.

Another object is a traction unit for a machine of the above type which is operative during working and inoperative during travel.

Another object is a tie plate setter that will work in either direction and for either rail.

Another object is a machine of the above type which drops or deposits the plates onto the tops of the ties with a miminum of bounce or disturbance.

Another object is a tie plate setter of the above type constructed to handle various size tie plates.

Another object is a machine of the above type which, while it does not require an operator, is arranged so that it will not run away from its attendant.

Other objects will appear from time to time in the ensuing specification and drawings.

BRIEF DESCRIPTION OF THE DRAWINGS

FIGS. 7–9 are different operative positions of the mechanism in FIG. 6.

DESCRIPTION OF THE PREFERRED EMBODIMENT

Figure 1:
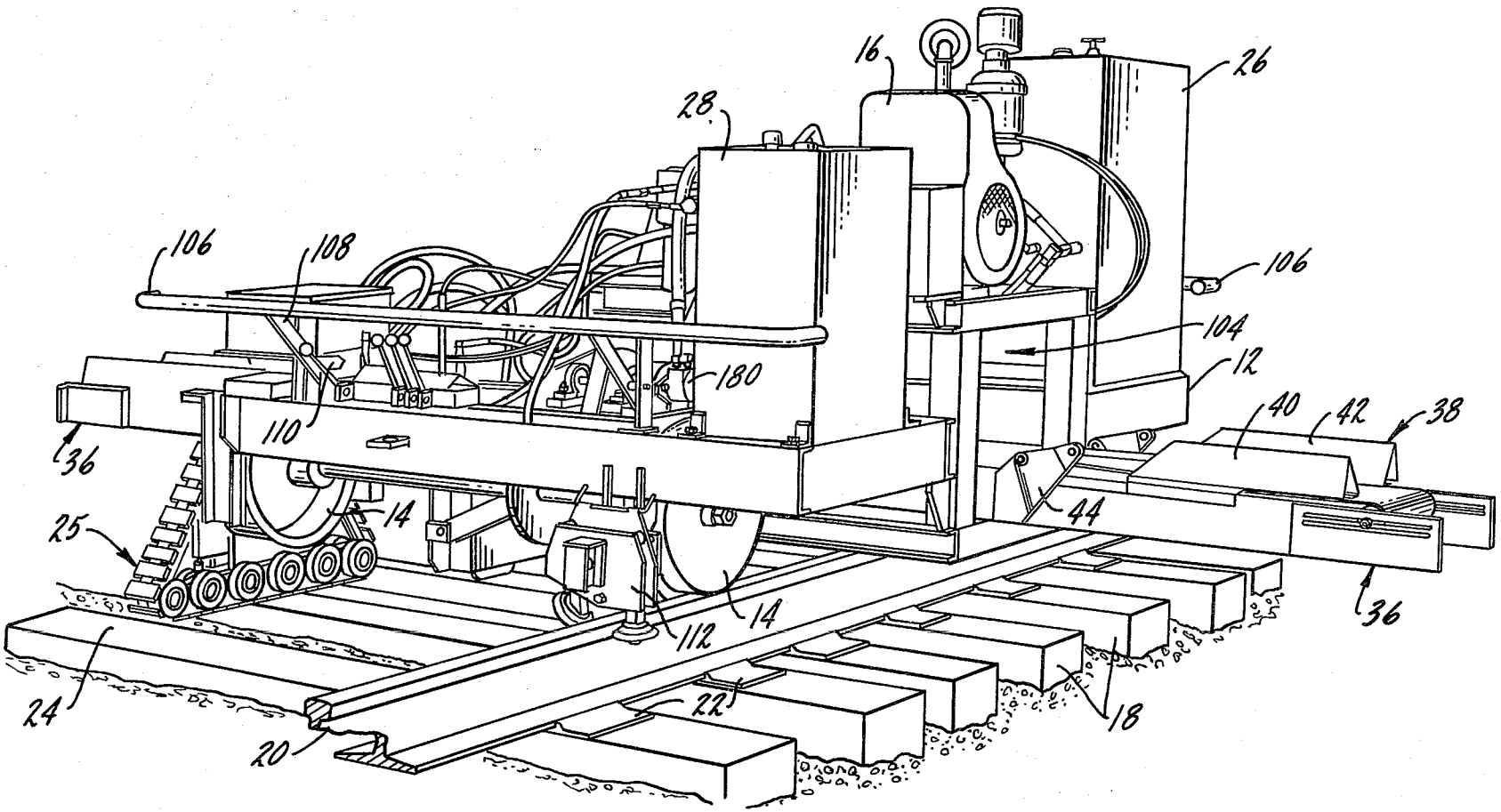
FIG. 1 is a perspective of the machine.
Figure 2:
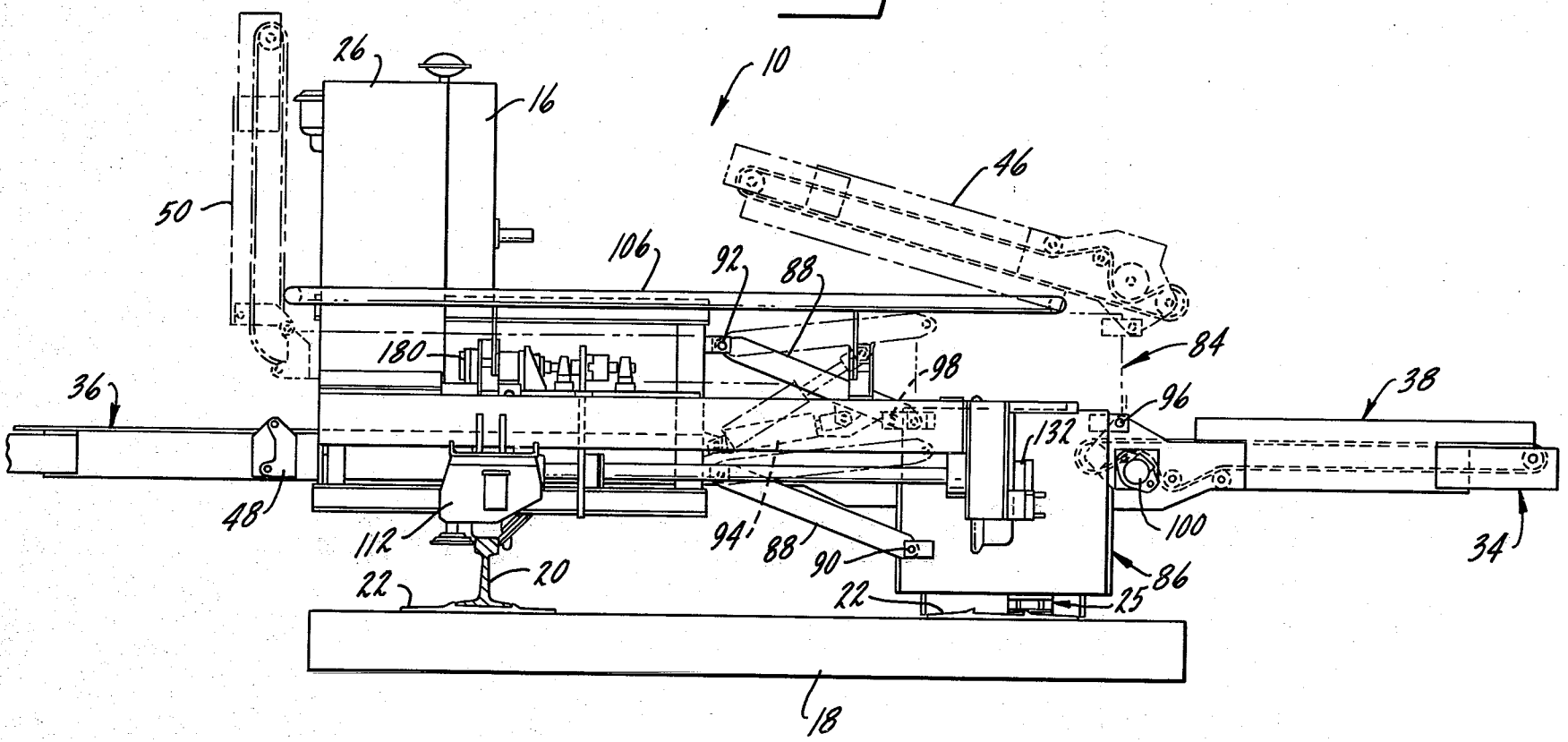
FIG. 2 is a rear view of the machine.
Figure 3:
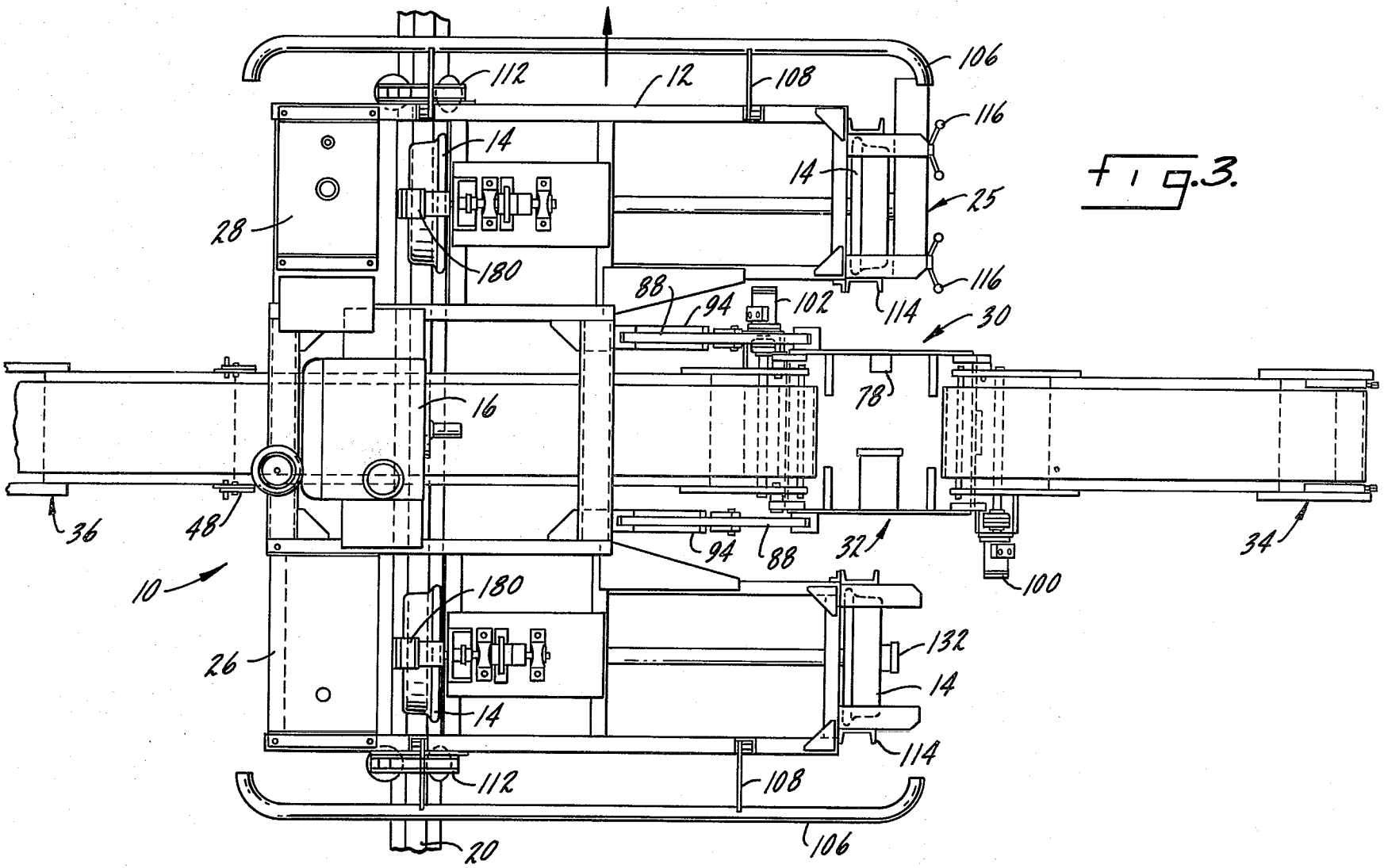
FIG. 3 is a top plan view of the machine.

In FIGS. 1–3 the unit has been shown or indicated generally at 10 and includes what may be considered a generally rectangular frame 12 with four wheels 14, one generally at each corner, on suitable axles with a propulsion mechanism, explained later, and driven by a suitable prime mover such as a gasoline or diesel engine 16 mounted on the frame. The unit has been shown on railroad track where ties 18 are positioned on ballast with a rail 20 on tie plates 22. It will be noted that only one rail has been shown in position and the location 24 for the other rail is blank. The object of the present machine is to position new tie plates along the ties, from one tie to the next, so that a new rail may thereafter be laid on top of the tie plates in the other rail location 24. A tractor unit 25 may be positioned on one side, as explained later. The frame also carries or supports a suitable tank or container 26 for hydraulic oil to be used in the hydraulic system, explained in detail hereinafter, and a gasoline or fuel tank 28 for the prime mover.

As shown in FIG. 3, the frame itself has a cutout or slot 30 on one side, which might be referred to as the working side, where a plate handler 32 is positioned. The plate handler is constructed and arranged to deposit new tie plates on top of the ties, one at a time, with a minimum of free fall, so that the plates will not bounce but rather will be accurately positioned in registry and gauge with the in place rail 20. The frame supports a conveyor which extends across the machine and laterally out each side for a predetermined or suitable distance. The conveyor in fact is made up of two sections which might be considered independent conveyors, first a short conveyor or section 34 which extends out from the working side of the frame, and a long conveyor or section 36 which extends out from the other side. The conveyors or sections 34 and 36 are in many ways quite similar and each may include a conventional belt extending around rollers at each end with intermediate rollers or plates or what have you for intermediate support, all of which is mounted on booms or extensions connected to the frame which in detail, in and of itself, is not important. Guides 38 are positioned on each side of the conveyor belt, each guide having an upstanding outer edge 40 and an inclined inner surface 42 with the spacing between the inner surfaces being such that a tie plate will only fit when disposed with its long dimension inward. This is to say that since a tie plate is rectangular and not square, the inner edges of the inclined surfaces 42 will only allow the narrow side of a tie plate to pass. At the same time, the guides are constructed and arranged so that the plates can be picked up off of the shoulders by one or more workmen or attendants and placed somewhat casually or thrown between the guides 38, the only criteria being that the long dimension of the plates should be more or less inward. The inclined surfaces 42 will properly align and center the plates therebetween and allow them to drop down on the belt which will move them inward to the plate handler 32. It will be understood that each of the conveyors has the same or similar guide mechanisms or plates 38 so that an attendant may pick up plates from either shoulder. The short conveyor 34 is pivoted by brackets at 44 so that it may be raised or pivoted back to the dotted line position 46 in FIG. 2 for traveling. Any suitable catch, lock or clasp may be used to hold it in its folded back position. The long conveyor 36 is also broken at a location adjacent the outer edge of the frame with brackets or pivots 48 which allow it to be raised to the broken line position 50 in FIG. 2 for traveling. The shorrt conveyor 34, if used, will feed plates directly to the plate handler 34 on the working side of the machine, whereas if the plates are on the other shoulder, the long conveyor 36 will feed them inwardly all the way across the machine to the plate handler.

Figure 4:
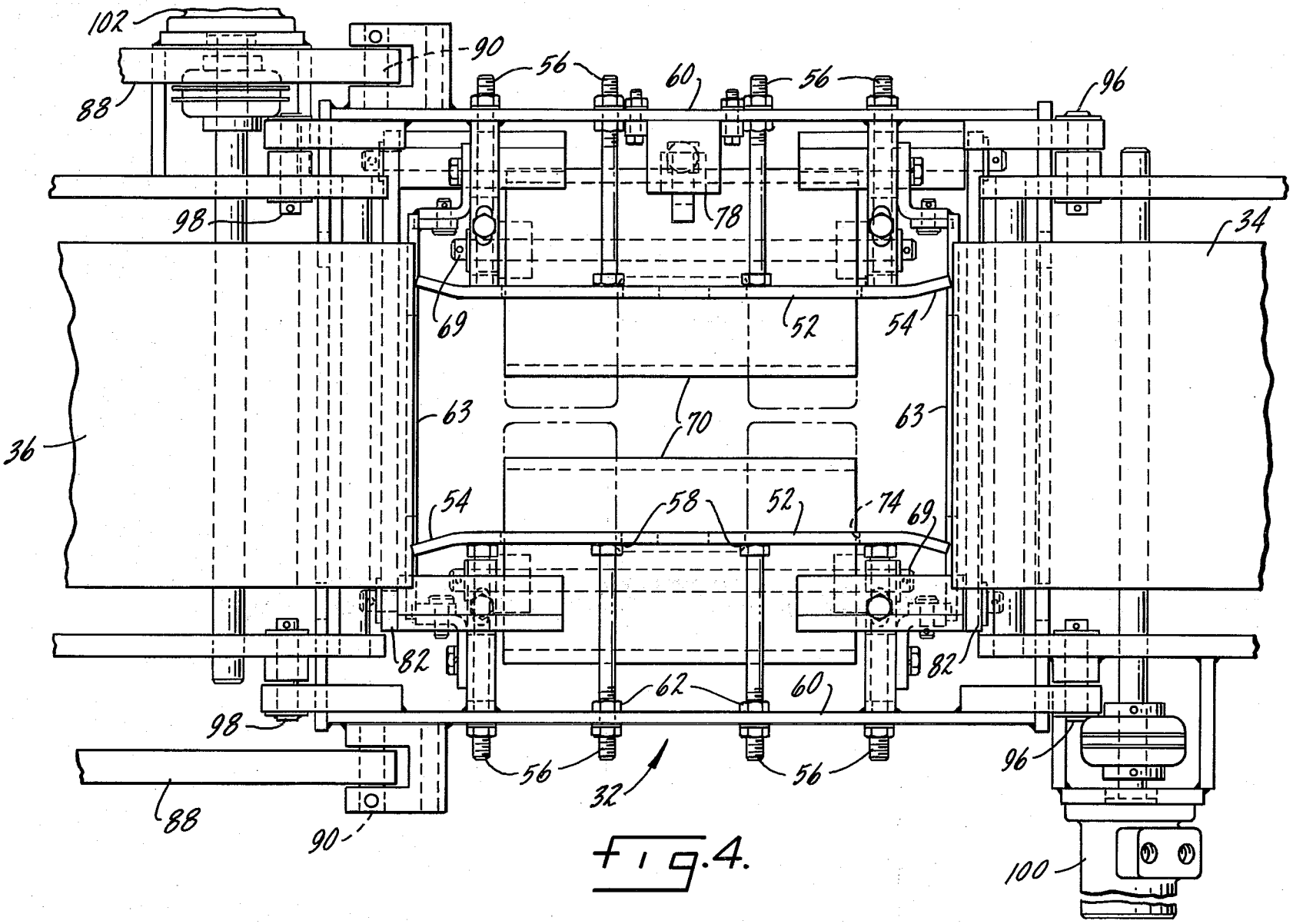
FIG. 4 is an enlarged view of a portion of FIG. 3.
Figure 5:
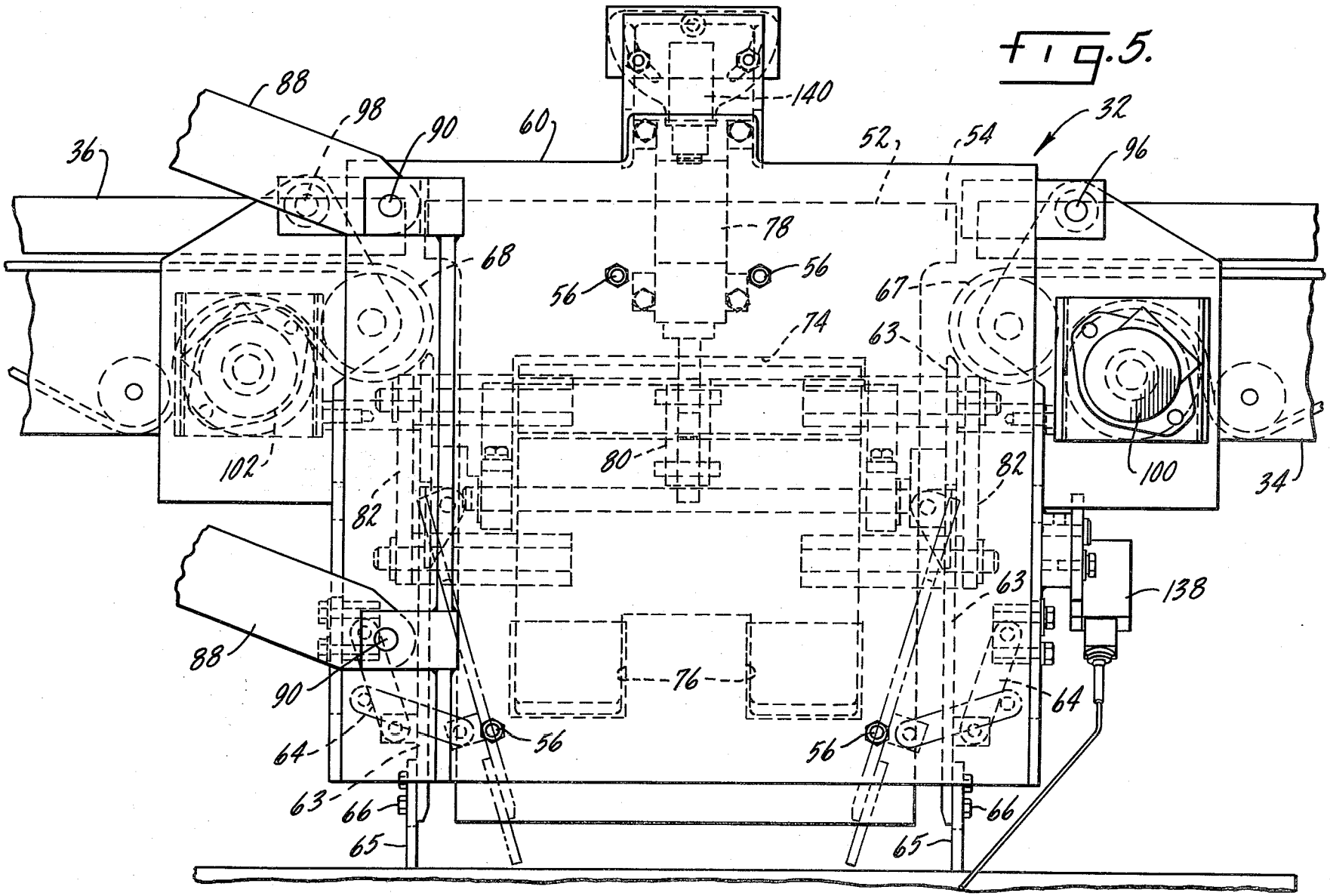
FIG. 5 is an end view of FIG. 4.
Figure 6:
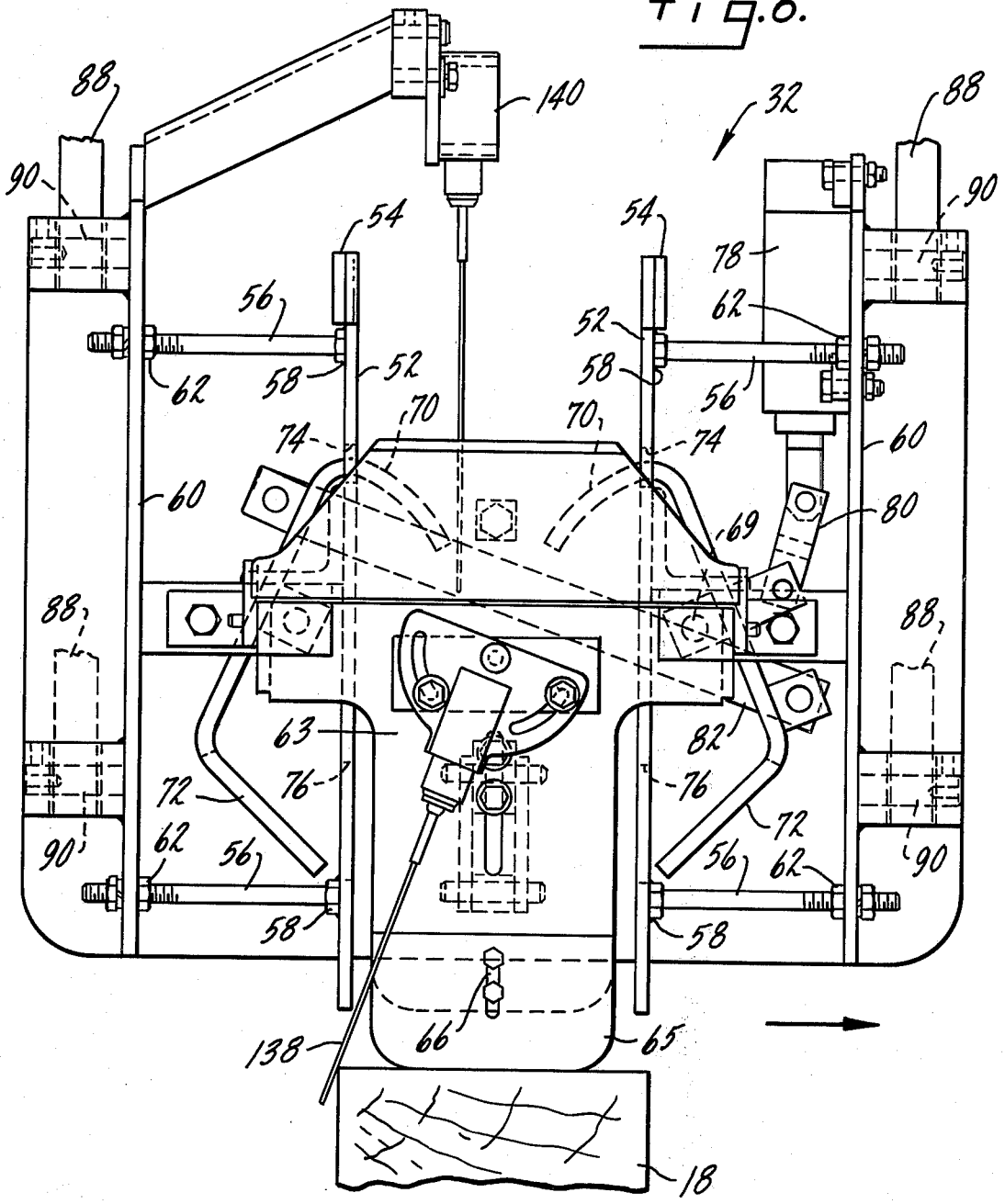
FIG. 6 is a side view of FIG. 4.

The plate handler itself is shown in detail in FIGS. 4–6 and is generally in the shape of a box or a chute, open top and bottom, with a cross section that more or less matches the size of the tie plates. The box or chute has similar end walls 52 flared somewhat at each end at 54 and mounted by suitable bolts or studs 56, the heads of which are welded as at 58 to the back of the walls 52 with the other end passing through a support plate 60 and adjustably held therein by locknuts 62. Thus the spacing between the walls 52 may be varied or adjusted so that the short dimension of different size tie plates may be accurately and easily accommodated and guided. The other walls are defined by plates 63, as shown in FIG. 5, which are pivoted at their upper ends, and are clamped in position by a mechanism 64, so that their lower ends can be spaced to accommodate different size tie plates. For quite accurate positioning, the tie plates have sliding extensions 65, which through a bolt and slot arrangement 66, shown in FIG. 6, allows the extension to actually rest on and slide along the tops of the ties when the feed chute or box is in its working position, with the forward and rear edges of the extensions rounded somewhat so that the extensions will ramp up on the ties. It will be noted in FIGS. 5 and 6 that the upper and lower ends of the walls or plates 52 and 63 are open with the inner ends 67 and 68 of the short and long conveyors, respectively, terminating at or adjacent the upper end of the plate handler. Thus the plates, whether they come from the long or the short conveyor, will be fed into the open upper end and allowed to drop down the chute. At a suitable location pairs of fingers or retainers are pivoted at 69 on the outside of the chute or box with upper and lower fingers 70 and 72 projecting therefrom through opening 74 and 76 in the sidewalls or plates 52. A suitable power cylinder 78 in FIG. 6 may operate the fingers through a linkage 80 with a cross link 82 between the fingers so that the movement of one moves the other, the arrangement being such that both of the upper fingers 70 will be "in" at the same time or "out," with the same being true of the lower fingers 72.

A sequence of events is shown in FIGS. 7–9 in which the other related mechanisms, plates, etc. has been removed so that the action of the tie plates moving through the feed setter as controlled by the fingers may be understood. In FIG. 7 the upper fingers 70 are "in," with the lower fingers 72 "out." A first tie plate has been brought into the box or chute from either the short or long conveyor and is dropped on top of the upper fingers and supported here. At a certain time the power cylinder 78 rocks the fingers to the FIG. 8 position in which the upper fingers 70 open dropping the plate down to the lower fingers 72 which have closed. Thus the plate will be, first, held in the upper position, then dropped, caught and held in the lower position. Next, at a certain time the power cylinder rocks the fingers back, which causes the lower fingers to retract, dropping the first tie plate in a short free fall to the top of the tie. This closes the upper fingers to the FIG. 9 postition to accept a second tie plate from either one conveyor or the other. It will be noted that the position of the lower fingers 72 is such that the tie plate will be dropped as short a distance as possible. This is to say that the bottom end of the feed chute or box and the location of the lower fingers 72 should be as close to the top of the tie as possible so that the free fall of the tie plate is at a minimum to avoid any bounce, rebound, or uneven contact when it hits the tie, which may cause skewing or misalignment.

The entire plate handler 32 is constructed to be raised and lowered between an upper position on the frame for traveling, as indicated generally at 84 in FIG. 2, and a lower position, indicated generally at 86, for working. In FIGS. 5 and 6 the feeder mechanism may be considered to be in the lower or working position. This raising and lowering is accomplished by upper and lower pantograph or parallelogram links 88 pivoted at 90 to the inner edge of the box or chute and on the other end at 92 to the frame. A power cylinder 94 is arranged to raise and lower the mechanism. The short conveyor 34 is mounted on the outside of the box by pivots 96 and the long conveyor is mounted on the inside by pivots 98, each having its own hydraulic motor mounted thereon, as at 100 and 102, to drive the belts. Since the two conveyors are actually mounted on the sides of the box or chute, they will be raised and lowered with it, as shown in the various broken line positions in FIG. 2 and the frame is constructed with a tunnel through it, as indicated generally at 104 in FIG. 1, so that the conveyors may be raised and lowered.

As shown in FIGS. 1 and 3, bumpers or contact elements 106 are mounted on each end of the frame and in the arrangement shown, take the form of an elongated rod or contact element mounted on extensions 108 which pivot to the frame and control switches 110 which, when energized, shut down the propulsion unit. The object of this is that if the unit should bump into another track-working machine, the bumper 106 will pivot up which will shut down the propulsion unit, regardless of which direction the machine is moving, so that the automatic operation of the unit will cease which will require the operator or attendant to restart the machine.

On the nonworking side of the frame, at each end, roller assemblies 112 shown in FIG. 1 may be positioned which engage both sides of the railhead to keep the machine on the single rail and accurately positioned. This insures accurate lateral positioning of the tie plates, as they are deposited on the other side.

Figures 10, 11:
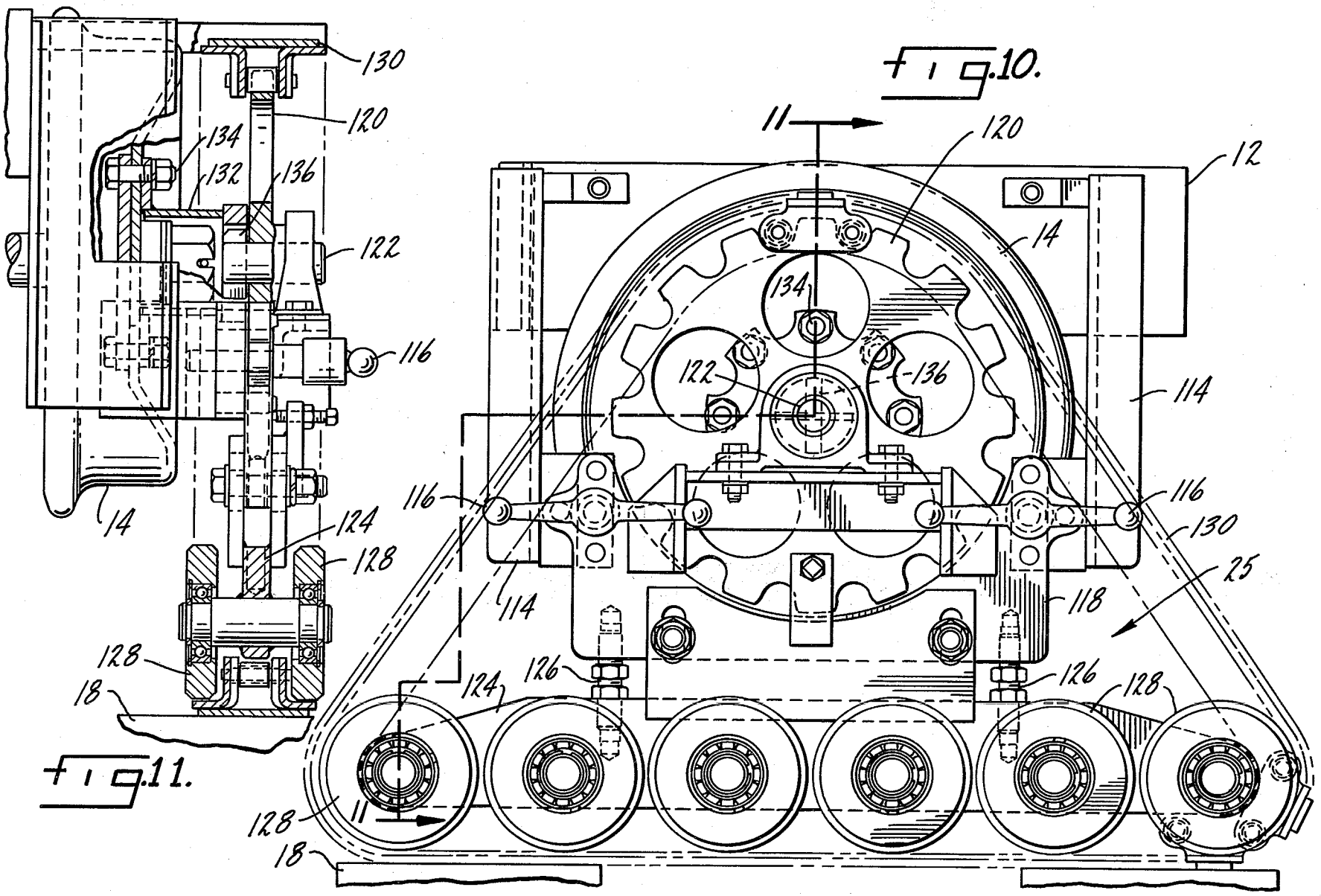
FIG. 10 is a side view of the traction mechanism.
FIG. 11 is a section taken along line 11—11 of FIG. 10.

In FIGS. 10 and 11 the tractor element 25 has been shown in detail and it should be understood that it may be removably clamped or connected to either of the wheels 14 on the working side of the frame, with the arrangement being such that the drive from the wheel will pass through to the tractor tread. The frame of the machine may include a manual or power crane or boom to handle the tractor unit during mounting or removing, if desired, and it may be stored in any suitable location. As shown, the arrangement includes a pair of brackets 114 connected to the main frame of the machine and extending down to accept two or more quick disconnect handles 116 which removably connect a subframe 118 thereto, the subframe carrying the tractor tread. The subframe 118 has an upper sprocket 12 rotatably mounted thereon at 122 with a crawler frame 124 therebelow adjustably connected to the subframe as at 126 to tension the tractor chain. The crawler frame 124 carries a series of wheels or rollers 128, shown in this case as six, although it could be more or less, spaced therealong over which a chain 130 passes. Wheel 14 carries a sleeve or adapter 132 connected thereto by a series of bolts 134 or the like and splined or keyed at 136 to the large upper sprocket 120 so the drive from the axle and wheel will power the upper sprocket and, in turn, will operate the chain.

As shown, the chain is adapted to move along the tops of the ties and the longitudinal extent along the lower rollers 128 should be such that, even on curves where the ties may diverge, the tractor should not fall into the crib between ties.

The machine automatically moves from tie to tie and a finger or feeler 138 may extend down, as shown in FIGS. 5 and 6, and, upon contacting a tie, may deenergize the propulsion mechanism so that the machine stops. A second contact element or feeler 140, shown in FIGS. 5 and 6, may detect when a tie plate enters the upper end of the chute or box, from either conveyor. For example, the feeler 140 would know and signal when a tie plate was held by the upper fingers — the FIG. 7 position. This would signal the machine to move to the next tie, and operate cylinder 78 in FIG. 6 to rotate the fingers from the FIG. 7 to the FIG. 8 position, dropping the ready tie plate to the lower fingers 72. As soon as feeler 138 contacted the next tie, propulsion would stop and cylinder 78 would be reversed to rock the fingers from the FIG. 8 to the FIG. 9 position, thereby dropping the ready tie plate from the ready position of FIG. 8 to the top of the tie. At the same time the upper fingers would move in to accept another tie plate. If another tie plate did not arrive at the upper end of the box or chute, feeler 140 would not be deflected and the machine would not propel to the next tie.

Figure 13:
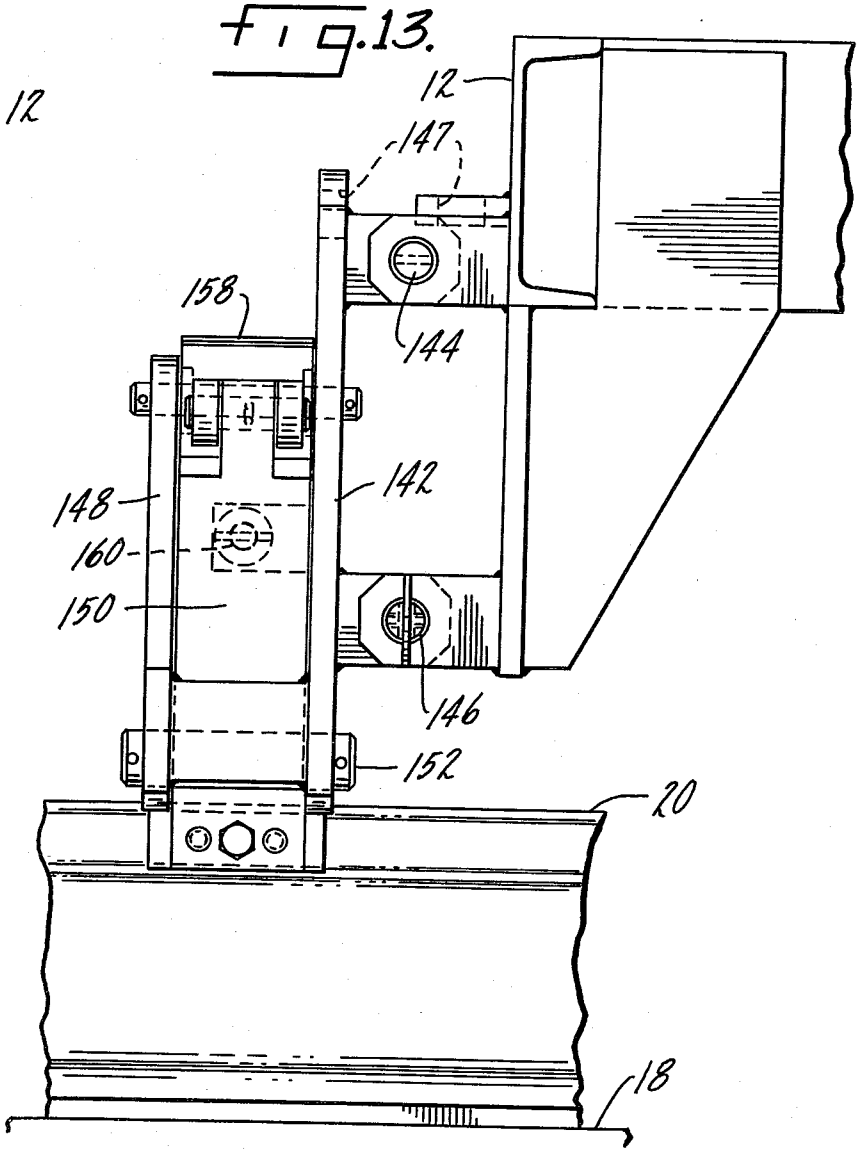
FIG. 13 is a side view of FIG. 12.
Figure 12:
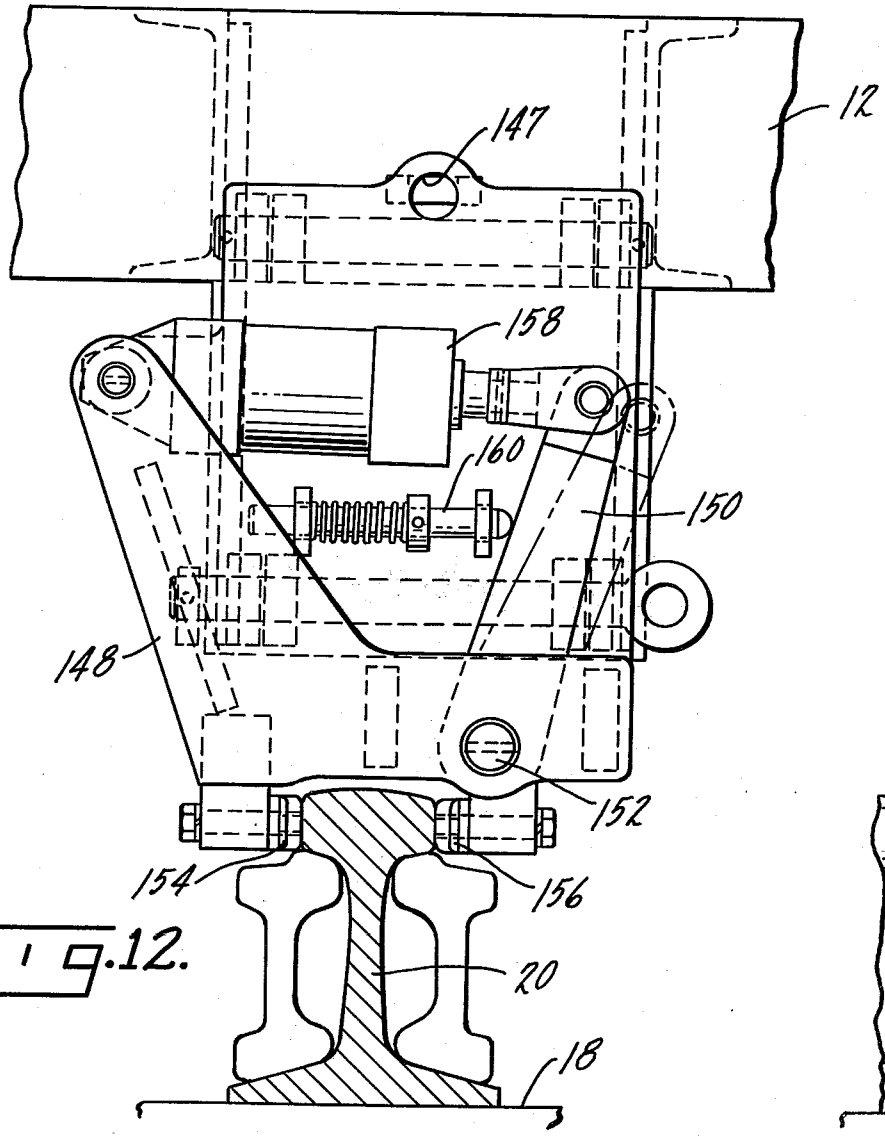
FIG. 12 is a front view of a modified form or addition.

To insure that the machine stops quickly and accurately, a braking or clamping mechanism may be used, along the lines shown in FIGS. 12 and 13 which may take the place of either one or both derailing roller units 112 in FIG. 1. Each brake or clamp may include a subframe 142 pivoted above at 144 and removably pinned below at 146 so that the lower end 146 may be removed and the entire unit pivoted up for traveling with pin 146 being put in aligned holes 147 to hold it up. Two clamps are used, one 148 fixed and the other 150 pivoted at 152, each having wearing pads or jaws 154 and 156 opposite the sides of the railhead, and dimensioned to clear the joint bars as shown in FIG. 12. The fixed jaw 154 is preferably on the inside which is the gauge side to insure accurate lateral positioning of the new plates. But under certain circumstances it might be otherwise. A cylinder 158 or the like is pivoted between their upper ends to force the bearing pads or clamping jaws toward each other to tightly grip the railhead. A spring loaded pin 160 also bears against arm 150 so that the clamping jaws are always slightly preloaded against the sides of the railhead. The spring is light enough such that when the unit is propelled, the jaws will slip along the sides of the railhead. The advantage of the spring is that when cylinder 158 is energized, clamping will be immediate with no lost motion or slack in the system. Thus, as soon as propulsion stops, the brakes will be immediately applied by the rail clamps which will cause the machine to come to an immediate and accurate stop which insures precise positioning of the tie plates. One fixed jaw or face has the advantage that it will serve as a bench mark for accurate positioning of the entire frame and thus the plate setter.

Figure 15:
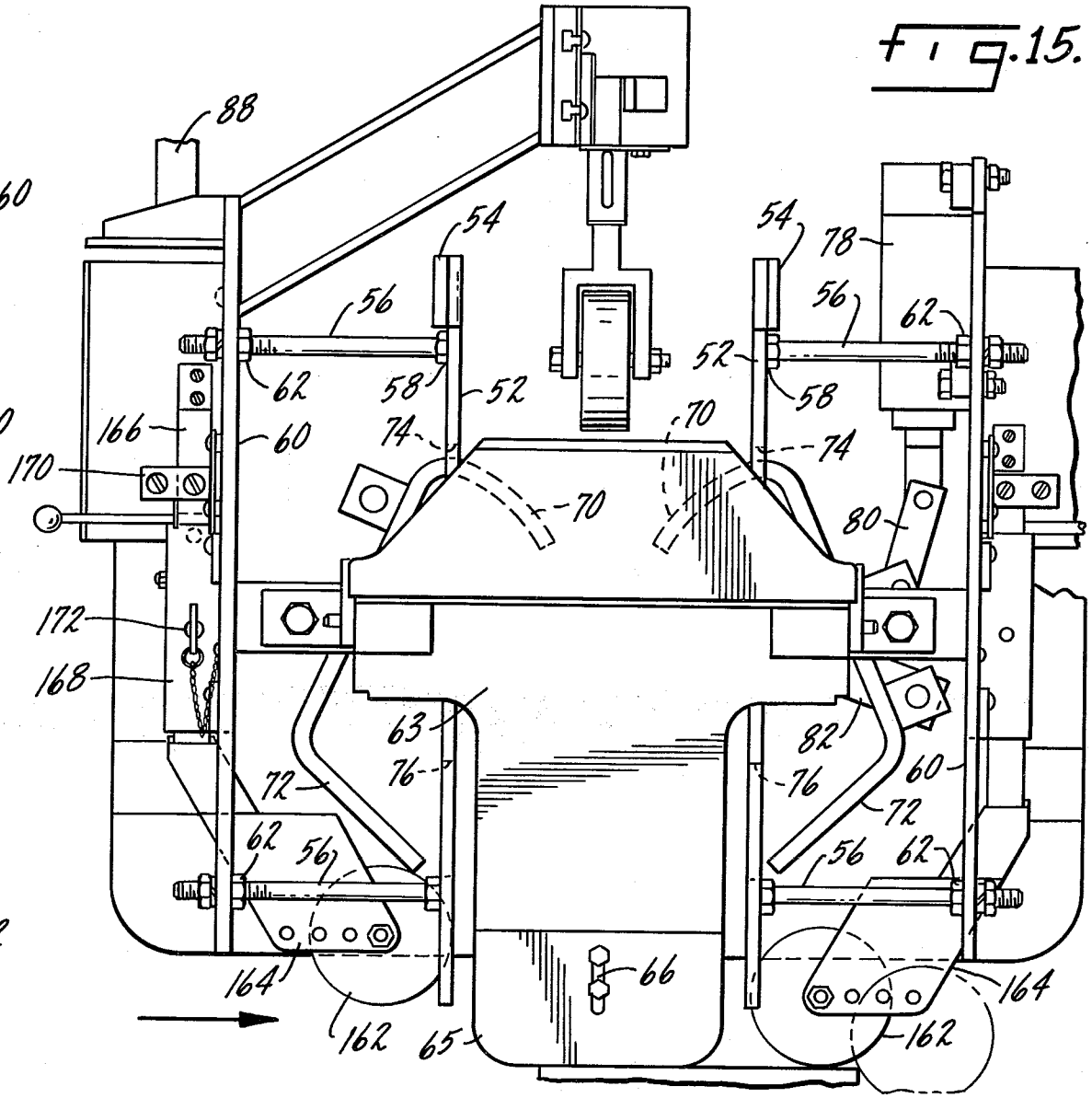
FIG. 15 is a side view of FIG. 14.
Figure 14:
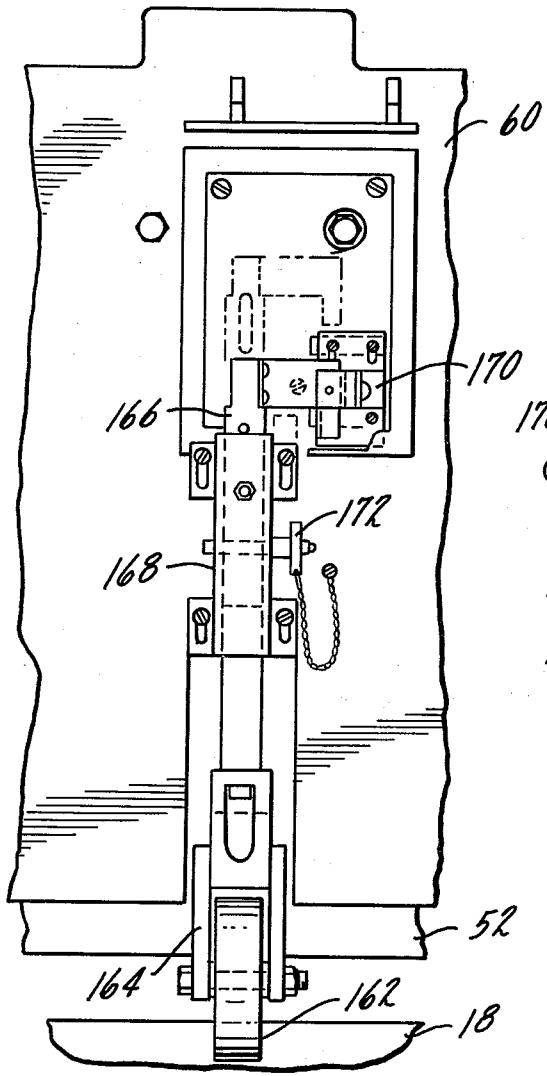
FIG. 14 is an end view of a further modification.

An alternate tie detector is shown in FIGS. 14 and 15 and the arrangement shown may be considered to be mounted on the outside of the box or plate setter generally in the position of detector 138 in FIGS. 5 and 6. The detector in FIGS. 14 and 15 includes generally duplicate tie contact elements for traveling in either direction, so only one will be referred to in detail.

A tie contacting roller 162 is mounted by a suitable bracket 164 on the bottom of a rod 166 which extends up through a guide or sleeve 168 to a detector 170 with a key arrangement 172 so that the roller may be held up in traveling position, as shown on the left side of FIG. 15, or may be lowered to float and engage ties and the ballast as shown on the right side in FIG. 15. The detector or sensor 170 may be of the type in which a light emitting diode and photo transistor receiver are aligned and positioned on the frame with a bracket or extension on the push rod disposed to interrupt or block the light (the full position in FIG. 14) when the roller 162 is down on the ballast and to be up and allow light flow (the broken line position of FIG. 14) when roller 162 is on top of a tie. The roller 162 is of a size such that it will roll across the ballast in the crib and will ramp up on the top of the tie without a great deal of resistance. The electrical element 170 may also be an interrupted light photocell arrangement or any suitable electricial contact and is arranged to signal when the operation roller falls off of the leading edge of a tie to stop the machine.

Considering FIG. 15, when the machine is moving in the direction of the arrow, the right side roller will be free to float in its tube or guide 168, which is the position shown, and the roller on the left will be up, pinned and inoperative. Thus the leading roller, depending upon the direction of movement of the machine, is operative and the trailing roller is held up so that it does not roll over and possibly misalign a just positioned tie plate.

Figure 16:
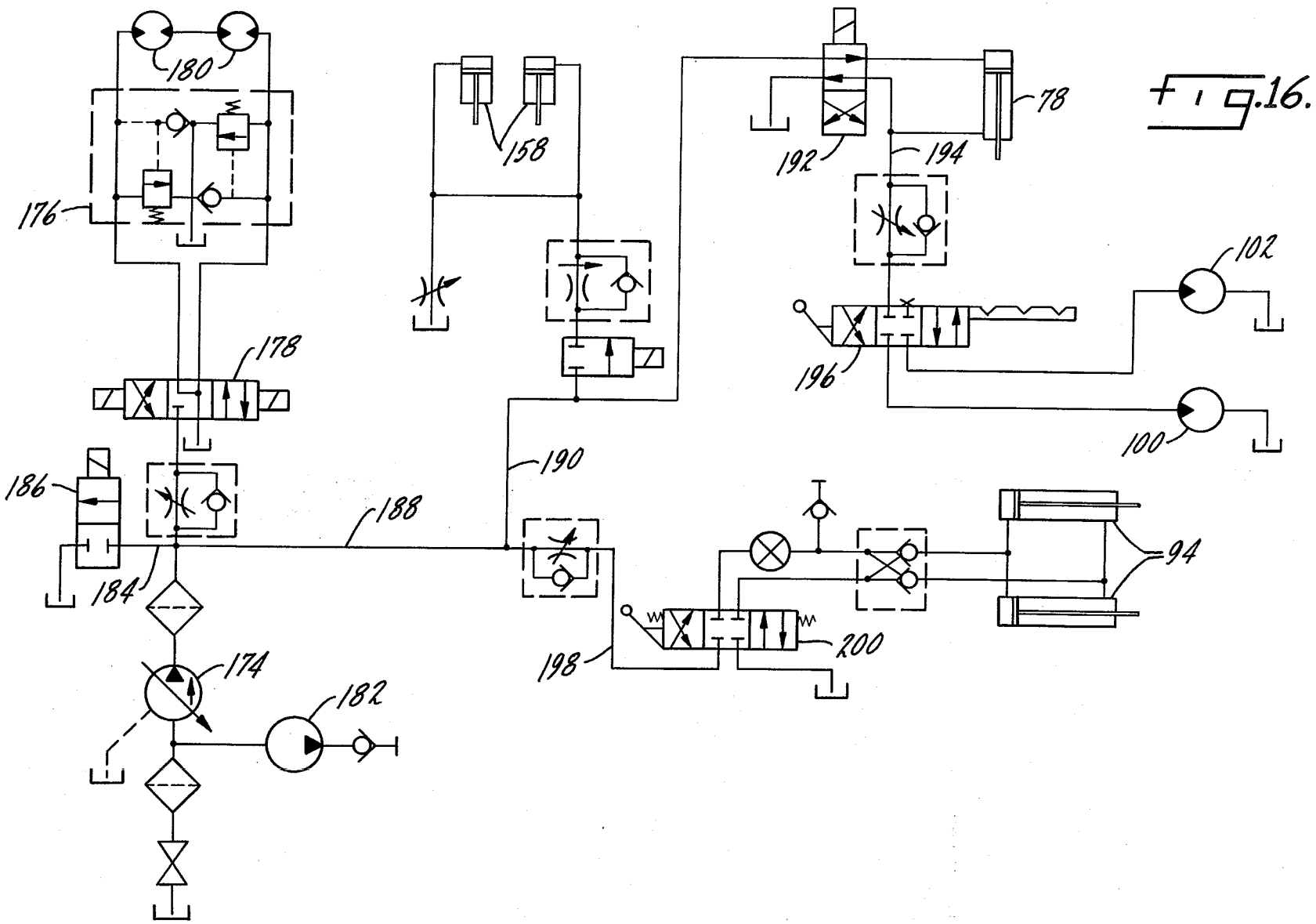
FIG. 16 is a circuit for the unit.

In FIG. 16 a circuit has been shown in which a pump 174, suitably driven by engine 16, supplies fluid to a propulsion system 176 through a suitable solenoid control valve 178 so that hydraulic motors 180, suitably connect to the axles, may propel the unit. An emergency hand pump 182 may be used, if desired. Fluid may also flow through a second connection 184 to an engine start control valve 186, also solenoid operated, so that load will not be on the main propulsion pump 174 when starting. A main line 188 carries fluid through a branch line 190 to the brake cylinders 158 and also to cylinder 78, through a suitable solenoid controlled valve 192 for operating the plate setter fingers with a side line 194 carrying fluid through a manual control valve 196 to the conveyor motors 100–102 so that operation of the conveyors and the plate setter mechanism will be coordinated. Another line 198 through a manual control valve 200 carries fluid to the lift cylinders 94 for raising and lowering the plate setter for working or traveling.

The use, operation and function of the invention are as follows:

The device is intended to enable one may to accurately position tie plates on the ties following adzing and preceding gauging of the rail, whichever is first. The machine will operate in either direction and for either rail. The operator only needs to start the machine and it will propel itself, in step by step fashion from one tie to the next, while the operator or attendant may be down on the shoulders placing the tie plates on either one conveyor or the other. The conveyor will feed a storage plate immediately above the plate release mechanism, which is located in the adzed area of the tie and at proper gauge. The plates will automatically be dropped onto the ties as they arrive at their proper location. The machine will automatically stop when it has dropped the last plate or when its storage has enough plates. If the machine is out of plates and stops, it cannot run away from its attendant. It will not keep moving down the track even though plates are not being deposited on the ties. In short, it is self-regulating in the sense that it will be either working properly or it will stop. It does not require close supervision by the attendant to make sure that it in fact is depositing plates on each tie.

Additionally, the positioning of the plates is quite accurate, due to the limited free fall and the accurate positioning and operation of its handling mechanism so that the plates do not require subsequent gauging prior to laying the new rail. Previously railroads have put new tie plates right in the middle of the track and then men were obligated to put them on the adzed ties at the proper location, properly orient them, then pregauge them with some sort of a mechanism prior to laying the new rail which was a haphazared operation. A rail gang would have two men out ahead who would pick up the tie plates from the shoulder and move them up to a position between the rail. Next, there would be two men behind them who would move the tie plates from the center position out to the adzed position on the tie. Then two more men would run some sort of a pregauging machine which would accurately position the new tie plates both laterally and longitudinally so that a new rail could then be laid. This made a total of six men. The present machine requires one and, at the most, two men. A man can be down on the shoulder picking up tie plates and throwing them on the end of one of the conveyors. The plates will be properly oriented and fed in by the conveyor to the plate handler. One man can work either on the near shoulder or the far shoulder. The machine itself may be unattended and will move step by step down the track depositing tie plates on the adzed position of each tie. The bumper mechanism allows the machine to move in either direction and if it overtakes another piece of equipment and bumps into it, the propulsion unit will be deenergized and the attendant will be required to come up and restart the machine. This calls to the attention of the attendant that he has overtaken another machine in the rail gang.

The crawler-tractor is put on the forward or leading wheel on the operative side of the machine so that it is running across the adzed positions on the ties. The trailing wheel on the working side will be above the newly positioned tie plate, by approximately the amount of rail height. The trailing wheel will not be running over and knocking the new tie plate out of position. The balancing arrangement is such that the machine will operate and be stable on its three point contacts, i.e. the two wheels on the nonoperative side plus the tractor in either position. Thus, after the gauger deposits a tie plate on the adzed position, the machine does not thereafter run over it or otherwise contact it. So its position should remain the same and be accurate.

Tie plates come in different sizes so the plate handle has its sides adjustable so that it may be set for any size tie plate in current use.

Various features of the invention disclosed and claimed herein are independent of each other and could well be used on other types of equipment. For example, the bumper technique on front and back which deenergizes the propulsion unit requiring manual starting again could well be used on other types of unattended railway maintenance machine and is not restricted to a plate setter. While the conveyor arrangement is highly desirable and considered an important part of the invention, other features of the device could be used where the plates are carried in a separate storage car and not thrown on the shoulder. Or the machine itself might be large enough to carry an adequate number of plates which could be manually placed in the plate handler by an attendant. However, putting the plates on the shoulder of the right-of-way and bringing them up to the adzed position on the ties is quite conventional and the conveyor arrangement shown is preferred.

Also, the conveyor arrangement might be used with a plate handler which physically lowers the tie plate from the ends of the conveyors down to the adzed position and does not let them drop in a series of steps, for example a plate handler that magnetically or mechanically grips and lowers the plates in a suitable manner from the inner end of the conveyor. The tractor tread does not have to be a removable element, but might be an integral part of the machine which could be raised and lowered, rather than being attached to a wheel. Nor does the tractor necessarily have to line up and run over the adzed positions on the ties. A tractor tread in the arrangement and location shown has the advantage that it will provide sufficient traction to move the machine, but it might be positioned elsewhere. The position shown is preferred so that the tread runs over the adzed places on the ties for level or smooth operation and a minimum of disturbance or bouncing. A gripping or tread arrangement might be used on one or both of the wheels on the other side to obtain whatever traction is necessary and the leading support on the operative side, next to the plate handler, might be a special wheel arrangement which could be lowered to engage the ties while working and raised to engage the rail while traveling. Or it might be a combination of wheels, one which could be lowered and would be smooth for use while working and a second flanged wheel at a somewhat higher location for traveling.

The braking arrangement shown in FIGS. 12 and 13 has the advantage that braking takes place immediately when propulsion ceases. Also, the brakes grab the rail itself so the machine comes to a quite accurate instant stop with little if any overtravel. Although the distance from one tie to the next is short, a machine of this type will have sufficient momentum that it may well coast or overtravel slightly. Thus an instantaneous, quickacting, braking mechanism that insures accurate positioning is highly desirable.

The tie detector arrangement in FIGS. 14 and 15 has the advantage that there is no wear on a dragging element, nor does the detector itself roll or drag across the just-positioned plate. The arrangement will operate in either direction and requires a minimum of operator-adjustment. The detector of FIGS. 14 and 15 might be used with any type of track-working machine and is not necessarily restricted to a tie plate handler.

While a preferred form of the invention and several variations thereof have been shown, it should be understood that numerous additional modifications, changes, substitutions and alterations may be made without departing from the invention's fundamental theme.

The embodiments of the invention in which an exclusive property or privilege is claimed are defined as follows:

1. In a machine for setting tie plates on top of the ties for a railroad track, a wheeled frame adapted to be moved along the track, a laterally disposed conveyor on the frame for bringing plates into the frame from the shoulder of the right-of-way, and a plate handler on the frame for lowering the plates, one at a time, for a conveyor to the ties constructed and arranged so that the plates will contact the top of the ties with their lower surfaces generally parallel to the upper surface of the ties and with a minimum of free fall thereafter so that the tie plates will be accurately positioned on the ties.

2. The structure of claim 1 further characterized by and including a power drive for the conveyor, and means for automatically energizing and deenergizing the power drive in response to the operation of the plate handler so that when the plate handler has a certain number of plates in process, the conveyor will be stopped, and vice versa.

3. The structure of claim 2 further characterized in that the plate handler includes a vertical chute on the frame arranged to receive plates adjacent its upper end and to deposit them on the tops of the ties at its lower end.

4. The structure of claim 3 further characterized by and including a plurality of fingers projecting at various levels into the chute and retractable therefrom so that the tie plates will fall down through the chute in steps.

5. The structure of claim 3 further characterized in that the chute is constructed as a unit and arranged to be raised on the frame for traveling and lowered so that its lower end closely approaches the tops of the ties for working.

6. The structure of claim 1 further characterized in that the plate handler is disposed on one side of the frame and aligned vertically with the location of one rail, and the conveyor includes two conveyor sections, a short section which extends out laterally from the side of the frame adjacent the plate handler, and a long section which extends across the frame from the plate handler and laterally out the other side so that plates may be fed to the plate handler from either shoulder.

7. The structure of claim 1 further characterized by and including guides on the sides of the conveyor spaced relative to each other and arranged relative to the conveyor so that when tie plates are dropped on the conveyor, the guides will align and orient them for proper reception and handling by the plate handler.

8. The structure of claim 1 further characterized by and including a tie detector on the frame for detecting when the machine is properly positioned over a tie, a propulsion unit on the frame making the machine self-propelled, and a control between the propulsion unit, tie detector and plate handler constructed and arranged so that when the tie detector senses that a tie is aligned with the plate handler, the propulsion unit will be deenergized so that the machine will stop over the detected tie and the tie handler will operate to deposit a plate on the tie.

9. The structure of claim 8 further characterized by and including a bumper on at least one end of the frame and a cutout control between the bumper and the propulsion unit so that when the bumper contacts an object on the track, such as another machine, the propulsion unit will be temporarily deenergized.

10. The structure of claim 1 further characterized in that the conveyor folds up so that it is above the frame for traveling instead of extending to one side thereof.

11. In a machine for handling tie plates for use in railroad track work, a frame adapted to be moved down the track, a conveyor on the frame for transporting tie plates thereon, and inclined guides on each side of the conveyor spaced and arranged so that when tie plates are deposited on the conveyor, the dimensioning is such that the tie plates will be aligned and oriented with their long dimension in the direction of conveyor movement.

12. The structure of claim 11 further characterized in that the conveyor is disposed laterally on the frame and extends out to one side of the track so the tie plates on the shoulder may be picked up and deposited on the conveyor which will cause the plates to be fed inwardly to the frame.

13. In a machine for setting tie plates on top of the ties for railroad track, a wheeled frame adapted to be moved down the track, a plate handler on the frame for lowering tie plates from an elevated position down to the ties, one at a time, with their lower surfaces generally parallel to the upper surface of the ties, the plate handler being constructed and arranged so that the plates will contact the tops of the ties after a minimum of free fall so that the tie plates will be accurately positioned on the ties, and means for supplying tie plates to the plate handler.

14. The structure of claim 13 further characterized in that the plate-supplying means includes a laterally disposed conveyor on the frame extending out from one side thereof for bringing plates into the plate handler from the shoulder of the right of way.

15. The structure of claim 13 further characterized in that the plate handler includes a vertical chute on the frame arranged to receive plates adjacent its upper end and to deposit them on the tops of the ties at its lower end.

16. The structure of claim 15 further characterized by and including a plurality of fingers projecting at various levels into the chute and retractable therefrom so that the tie plates will fall down through the chute in steps.

17. The structure of claim 15 further characterized in that the chute is constructed as a unit and arranged to be raised on the frame for traveling and lowered so that its lower end closely approaches the tops of the ties for working.

18. In a machine for setting tie plates on top of ties for railroad track, a wheeled frame adapted to be moved down the track, a plate handler on the frame for lowering tie plates from an elevated position down to the ties, one at a time, the sides of the plate handler being adjustable so that it will handle different size tie plates, and means on the frame for supplying tie plates to the plate handler, the tie plate handler being in the form of a vertical chute arranged to receive plates adjacent its upper end and to deposit them on the tops of the ties at its lower end, the sides of the chute being adjustable toward and away from each other to accept different size tie plates.

19. In a machine for setting tie plates on top of the ties for railroad track, a wheeled frame adapted to be moved down the track, a plate handler on the frame for lowering new tie plates down to the ties, one at a time, and a mounting for the plate handler so that it may be raised for traveling and lowered to a position close to the tops of the ties for working.

20. In a machine for setting tie plates on top of the ties for railroad track, a wheeled frame adapted to be moved along the track, a laterally disposed conveyor structure on the frame for bringing tie plates into the frame from the shoulders of the right-of-way, and a plate handler on the frame for positioning the tie plates on the tops of the ties, the plate handler being disposed on one side of the frame and aligned generally with the location of one rail, and the conveyor structure including two conveyor sections, a short conveyor section which extends out laterally from the side of the frame adjacent the tie handler, and a long conveyor section which extends across the frame from the plate handler and laterally out the other side of the frame so that tie plates may be fed to the plate handler for either shoulder.

21. In a machine for doing work automatically on railroad track unattended, a wheeled frame adapted to move down the track step-by-step, a propulsion unit on the frame for making the machine self-propelled, means for the frame for doing work on the track, a contact element on at least one end of the frame and at a level above the rail, and a switch operated by the contact element and interconnected to the propulsion unit so that the machine automatically moves down the track doing work thereon but when the contact element engages an object on the track, such as another track-working machine or the like, the propulsion unit will be automatically deenergized, thereby requiring operator intervention to start the automatic operation of the machine again, the machine being constructed to set tie plates on top of the ties, a laterally disposed conveyor on the frame for bringing tie plates into the frame from the shoulder, and a plate handler on the frame for lowering tie plates from the conveyor to the tops of the ties.

* * * * *